United States Patent [19]

Gundlach

[11] 4,005,654

[45] Feb. 1, 1977

[54] PROCESS FOR SHALLOW RELIEF PRINTING

[75] Inventor: Robert W. Gundlach, Victor, N.Y.

[73] Assignee: Xerox Corporation, Stamford, Conn.

[22] Filed: Dec. 23, 1975

[21] Appl. No.: 643,716

Related U.S. Application Data

[63] Continuation-in-part of Ser. No. 207,846, Dec. 14, 1971, abandoned.

[52] U.S. Cl. ..... 101/426; 101/170; 101/350; 101/395; 101/401.1; 101/471

[51] Int. Cl.[2] ..... B41M 1/02; B41N 1/12; B41F 31/22

[58] Field of Search ..... 101/350, 395, 401.1, 101/170, 471, 150, 426

[56] References Cited

UNITED STATES PATENTS

| | | | |
|---|---|---|---|
| 2,247,540 | 7/1941 | Yanes | 101/170 |
| 2,310,788 | 2/1943 | Hommelchen | 101/350 |
| 2,878,096 | 3/1959 | Wood et al. | 101/426 X |
| 3,093,071 | 6/1963 | Taylor | 101/150 |
| 3,223,838 | 12/1965 | Hoshino et al. | 101/471 X |
| 3,455,239 | 7/1969 | Smith | 101/395 |
| 3,613,578 | 10/1971 | Heurich | 101/350 |
| 3,645,204 | 2/1972 | Gosnell | 101/395 |

*Primary Examiner*—Clyde I. Coughenour
*Attorney, Agent, or Firm*—James J. Ralabate; James P. O'Sullivan; Donald M. MacKay

[57] ABSTRACT

A printing process is provided whereby a resilient image having a relief of from about 4 to 50 microns is formed on the surface of a hard, non-resilient substrate to form a printing member. The printing member is then contacted with a gravure donor member having disposed therein a liquid developer wherein said developer resides within cells from about 4 to 50 microns below the surface of the contact plane at a depth such that the developer contacts the image but not the non-imaged areas of the master so that said contacting selectively transfers said developer to said resilient image but not to the non-imaged areas, and the printing member is then contacted with a receiver sheet to transfer the developed image.

6 Claims, 5 Drawing Figures

INVENTOR
ROBERT W. GUNDLACH
BY
ATTORNEY

PROCESS FOR SHALLOW RELIEF PRINTING

CROSS REFERENCE TO RELATED APPLICATION

This is a continuation-in-part application of Ser. No. 207,846 filed Dec. 14, 1971 now abandoned.

BACKGROUND OF THE INVENTION

This invention is directed to a process for printing in which high quality prints are obtained from images of negligible relief without the requirement of a dampening or fountain solution.

In order to be suitable as relief image carriers, the master image must have the proper depth. This depth is the distance between the level of the printing surface and the non-printing areas of a master. Line engravings that are to be used on high-finished papers are usually etched to a depth of approximately 0.020 inch or 500 microns. Engravings made for flexographic printing and for printing on rough papers have a depth of 0.040 inch and more or 1000 microns and more. (*The Printing Industry* by Victor Strauss (1967) published by the Printing Industries of America, Inc.).

Because of the relatively large image relief required in conventional masters, they are difficult to prepare as well as costly and time consuming to prepare. Additionally, high relief resilient, or elastomeric images produce smeared, unsharp or poorly defined images because of lateral shifting, sometimes called "squirm" in flexographic printing. Consequently, a method of printing employing masters having images of low relief, which could be rapidly and inexpensively prepared, and could print with better image definition would be highly desirable and in accordance with this invention such a method is provided.

BRIEF SUMMARY OF THE INVENTION

In accordance with the invention a printing process is provided comprising forming a resilient image having a relief of from about 4 to about 50 microns on the surface of a hard, non-resilient substrate, and the member contacted with a gravure donor member having disposed therein a liquid developer wherein the developer resides within cells from about 4 to about 50 microns below the surface of the contact plane so that said contacting selectively transfers said developer or ink to said resilient image and not to the background areas. The developed or inked printing member is then contacted with a receiver sheet to transfer the developed image.

DETAILED DESCRIPTION OF THE INVENTION

Figure 1:
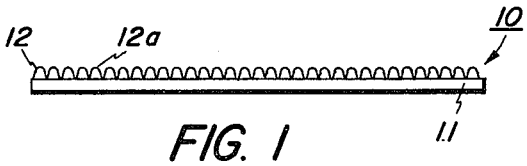
FIG. 1 is a sectional view of a gravure donor member.

Referring to FIG. 1 there is seen a developer donor or dispensing member designated 10, comprising a support base 11, having disposed on its surface a raised pattern 12, which may, for example, comprise a plurality of fine raised lines, dots or other raised material.

This member is characterized by retaining developer or ink in the depressions or recessed areas (valleys) formed by the raised areas 12 (lands), following doctoring, while the doctor blade removes the developer from the surfaces **12*a* of the raised areas 12. Any suitable material may be used as the support substrate 11, such as aluminum, zinc, copper, glass or organic resins such as polyester, polycarbonate, vinyl polymers, acetates and the like. The substrate material may be macroscopically flexible so as to conform to conventional printing cylinders, but not microscopically resilient so as to conform to the gravure pattern of the ink dispenser surface. The pattern of the raised areas 12 on the support base 11** will generally be finely divided, desirably having a regular or at least a substantially uniform configuration sufficient to keep the developer out of contact with the surface of the background or non-image area of the printing master.

The finely divided, raised pattern 12 may be placed or formed on the support base 11 by any suitable means. For example, a photoresist coating may be used to provide a pattern on the surface of the support base by conventional photographic means made up of a plurality of half-tone dots or a pattern of fine lines. Generally, a pattern of ridges is preferred so that the raised areas or lands form a continuous network. The pattern can be formed by electrophotographic means. For example, a commercial xerographic plate may be charged and exposed to light projected through a half-tone screen and the resulting electrostatic image conventionally developed with a resinous toner to produce a half-tone dot pattern. This pattern is then transferred to the surface of a support base such as a zinc substrate and is fused to provide a permanently adhering raised dot pattern. The dot pattern should be relatively fine, generally at least a 60 line screen and preferably between a 100 and about 300 screen. The height of the raised pattern may range from about 5 to 50 microns with the preferred height being about 15 microns to obtain the desired optimum effect at the least limiting relief. The pattern can also be formed by photochemical and other means well known and commercially available in the art.

Figure 2:
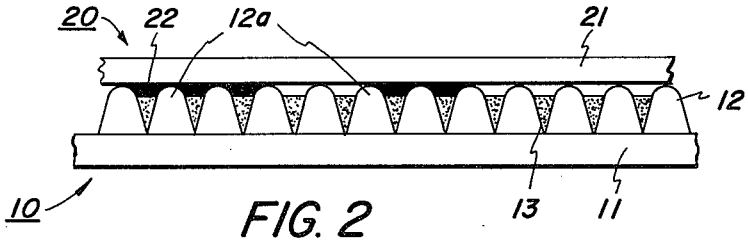
FIG. 2 is an enlarged sectional view of the gravure donor member having developer in the cells which member is in contact with an imaged printing master.

Referring now to FIG. 2, there is seen a magnified view of the effect realized when utilizing an ink dispenser as described above. An imaged member 20 comprising a non-resilient support base 21 and resilient image 22 is contacted with the donor surface of dispensing member 10. The developer dispenser is prepared to use by applying flexographic ink in a manner so as to fill the valleys or recessed areas between the raised portions of the dot or screen pattern. After applying the flexographic ink to the gravure surface of the dispensing member, the ink is removed from the surface of the raised areas by a flexible wiper blade such as a Teflon or rubber squeegee. This levels the ink in such a manner so that it fills the recessed areas to a point just below the surface of the raised lands 12 so that only the imaged areas of the master are inked when the master and gravure donor member are contacted with one another. This assures that the ink or developer will not contaminate the background of the imaged support member 20 which is brought into contact with the raised portions of the gravure donor dispensing member 10. Thus, when the smooth, hard surface of the imaged support is pressed into contact with the gravure developer dispenser, the background surface will contact only the lands or non-inked peaks of the pattern and not the developer fluid.

Any suitable flexographic printing ink may be used to carry out the process of the present invention such as is disclosed in "The Printing Industry" by Victor Strauss, page 611. Flexographic inks are less opaque and color strong than non-evaporating inks. They can be used on papers, metal foils, and plastic materials. Flexographic inks may be classified as (1) alcohol and water based inks, both transparent and opaque, (2) transparent and opaque inks based on special solvents which include various alcohols and also naphthas, and (3) various blends of the transparent and opaque inks belonging to the same solvent class to provide semi-pigmented alcohol-based inks, water-based inks and inks based on special solvents. The alcohol-type inks, for example, may contain as a film former shellac, alcohol soluble copals and damars as well as maleic and other synthetic resins. Non-drying oil base inks have also been found to be satisfactory and offer the advantage that the inked surfaces do not have to be cleaned for short shut-down periods. They are also less susceptible to changing viscosity over long runs.

Referring once again to FIG. 2, upon intimate contact of the imaged member 20 with the gravure donor 10, the resilient image 22 will conform with and dip down into the recesses of the gravure donor to be wetted by the ink retained therein. Even though the non-imaged areas into intimate contact with the superficial surface areas 12*a* of the lands, (i.e. contacting the lands or project slightly into the valleys) ink does not contact the background areas, thus eliminating contamination and background degradation heretofore avoided only by utilizing images of very high relief so as to avoid all contact of the base portion of the printing plate with the gravure ink applicator or a hydrophylic background, a fountain solution, and high-tack inks to prevent inking of the background areas. Due to the combination of events of the present invention these requirements are no longer necessary. Thus, developer reaches the imaged master only in the imaged areas. For image development, the surface of the gravure developer dispensing member is pressed either the entire area simultaneously or progressively into line contact with the plate supporting the resilient image, causing developer to transfer to the imaged surface in conformity with the resilient image. When dealing with ridged surfaces where the ridges of the developer dispenser are co-extensive with one another, it has been found desirable to move the developer dispenser or ridged member realitive to the surface being developed in at least two directions during the development. This may necessitate two passes to complete the development phase of the process. However, a single positioning or development step yields adequate quality for most applications.

Figure 3:
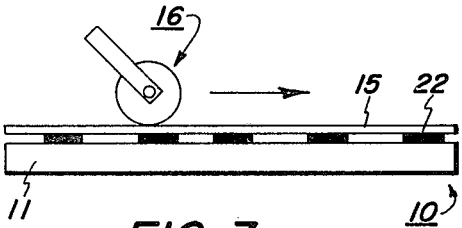
FIGS. 3 and 4 represent schematic views of the image transfer step from the master to the receiver sheet.
Figure 4:
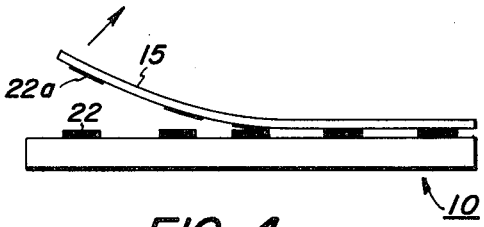

FIGS. 3 and 4 illustrate the transferring of an image from the developed or inked master plate 10 to a paper receiver sheet 15. A pressure means 16 represented in the form of a roller is passed across the upper surfaces of the receiver sheet and presses into intimate contact both in the background and image areas of the imaged member 10. Thus, all areas of the master make contact with the paper; however, only the resilient imaged surface carries ink. As a result, when the transfer member 15 contacts the background areas of the substrate 11 there is no contamination of the receiver sheet and thus, only ink present on the surface of the resilient image 22 contacts the surface of the receiver sheet 15. Inasmuch as the height of the resilient image is almost negligible, and the image material is of low durometer, minimal pressure is necessry to transfer a print from the flexographic master to the respective receiver sheet, and applied pressure is very uniform regardless of the size of the printing areas.

FIG. 4 represents the separation of the receiver sheet 15 from the printing member 10 illustrating the printing capability and final results of the present invention. An imprint 22*a* is observed on the surface of the transfer member 15.

Figure 5:
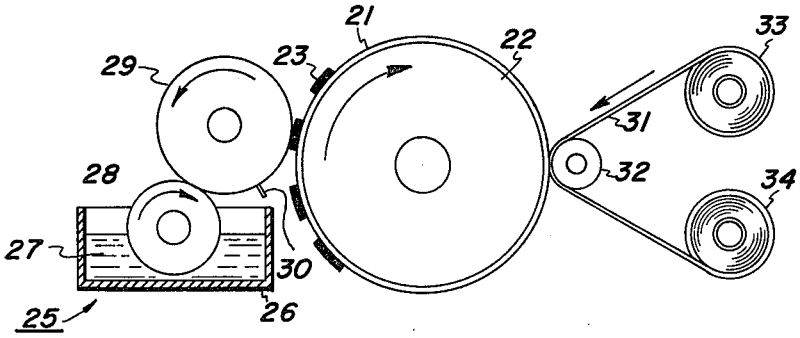
FIG. 5 is a sectional view of a continuous imaging apparatus implementing the process of the invention.

Referring now to FIG. 5 there is seen a continuous imaging apparatus utilizing the concept of the present invention. As illustrated, an imaged printing master 21 is fixed to the surface of the printing cylinder 22. The printing cylinder is rotated in the direction indicated by the arrow. A developer, or inking, station is provided generally designated 25, comprising an ink sump 26 containing therein the printing ink 27. An ink applicator roller 28 transfers the ink from sump 26 to the surface of a gravure developer dispenser or applicator as is described in FIG. 1 and herein represented as 29. A flexible squeegee or doctor blade 30 is positioned so as to level the ink deposited in the cells of the gravure developer applicator to remove developer at the top of the valleys and provide the effect desired. Ink remaining in the gravure member 29 slightly below the surface of the contact plane is then transferred selectively to the resilient image 23 of the printing master 21. Next in the direction of rotation following development is a transfer station. The inked image is contacted with a transfer sheet 31 which is brought into surface contact with the inked or developed master by impression roller 32. The flexibility of the inked image areas provides excellent conformity to paper surfaces, so that a dense, unbroken ink film is transferred to the paper in spite of the natural irregularities of its surface. The receiver sheet or transfer member 31 is provided by way of roller 33 and is rewound on take-up roller 34.

The printing master of the present invention may be prepared by any suitable technique such that a resilient low relief image is formed on a substantially non-resilient hard substrate. Various techniques capable of being utilized in preparing the resilient imaged member include photodecomposition, photopolymerization, the use of photoresists, electrostatic techniques, utilization of silver haloid chemistry, diazo processes, the utilization of photochromic materials and related techniques. For example, in utilizing electrophotographic principles, an electrostatic latent image is formed on the surface of a photoconductive member and a resulting image developed by a suitable developing technique utilizing soft resilient resinous toner materials such that upon transfer in imagewise configuration and fixing to a suitable substrate of the present invention, there is produced a printing master comprising an imaged surface of minimal relief. The photoconductive member may be utilized as the non-resilient substrate in which instance the transfer step may be eliminated. The resinous toner material may be a resilient foamed material. Photodecomposition techniques have been demonstrated wherein an elastomeric photosensitive material is exposed selectively so as to bring about a decomposing of the resilient material in the exposed areas. Such materials as polyacetaldehyde and sensitized polybutadiene rubbers have been used in such a system. Selective hardening through photopolymerization or heat exposure of resilient materials such as exposing sensitized polybutadiene rubber to actinic radiation or heat have been found successful. The exposed areas are cross-linked and the unexposed areas are dissolved away to produce a resilient image. Photoresists have also been used to produce the soft resilient image on the non-resilient substrate, such as the utilization of polyvinyl-alcohol mixed with ammonium dichromate. The image material must be sufficiently resilient to conform to the ink dispensing surface to reach into contact with the ink residing below the contact plane.

The resilient image of the present invention will have a relief of at least about 4 microns with the preferred operating conditions falling within an image height ranging from the lower limitation up to about 50 microns. An optimum operating range will be from about 7 to 15 microns. Obviously, the printing member of the present invention will function in the manner prescribed when the relief of the image is still greater than the 15 micron upper limit of the optimized range. However, in doing so one would defeat one of the obvious advantages of the present invention, that being the capability of utilizing a master having a resilient image of negligible relief while retaining all the desirable characteristics of flexographic printing. Therefore, in order to achieve the results desired, image height should be restricted to at least less than 50 microns and preferably, as stated, less than 15 microns.

It is to be understood that it is not intended that the structural arrangement of the apparatus described in the present invention as set out in FIG. 5 be restricted to the design illustrated therein and it is intended that all similar configurations satisfying the requirements of the present invention be encompassed within the breadth of this disclosure. For example, more than one form of developer dispenser may be used in combination with the printing apparatus. In addition, the modifications may be made to the present system as described so as to enhance the ultimate results. For example, by making the ridges or lands of the developer dispenser of low surface energy material such as siloxane, Teflon, etc., and by using a higher viscosity, cohesive ink, the raised areas may be made to remain inkfree without the need for doctoring.

Anyone skilled in the art will havve obvious modifications occur to them based on the teachings of the present invention. These modifications are intended to be encompassed within the scope of the present invention.

What is claimed is:

1. A printing process comprising forming a resilient image having a relief of from about 4 microns to about 50 microns on a hard, non-resilient surface forming a background for the image, providing a gravure donor member, providing a liquid developer recessed within the cells of said gravure donor member from about 4 microns to about 50 microns below the surface of the contact plane, contacting both image and non-image areas of the master with the gravure donor member whereby the resilient image reaches into the recesses to contact and remove developer whereby said contacting selectively transfers said developer to said resilient image and not to the background areas of the master, and contacting said developer resilient image with a receiver sheet to transfer said developed image to said receiver sheet.

2. The process as disclosed in claim 1 wherein said resilient image is formed with a resilient resinous material.

3. The process as disclosed in claim 2 wherein said resilient image is formed with a foamed resinous material.

4. An imaging process comprising providing a master having a resilient image with a relief of from about 4 microns to about 50 microns on a hard, non-resilient surface forming a background for the image, providing a gravure donor member, providing a liquid developer recessed within the cells of said gravure donor member from about 4 microns to about 50 microns below the surface of the contact plane, contacting both image and non-image areas of the master with the gravure donor member whereby the resilient image reaches into the recesses to contact and remove developer whereby said contacting selectively transfers said developer to said resilient image and not to the background areas of the master, and contacting said developed resilient image with a receiver sheet to transfer said developed image to said receiver sheet.

5. The process as disclosed in claim 4 wherein the master which is contacted with a gravure donor comprises an image having a relief from about 4 to 15 microns and the developer resides within the donor cells from about 4 microns to about 15 microns below the surface of the contact plane.

6. The process as disclosed in claim 4 wherein said contacting of the master with the gravure donor and said contacting of the developed image with said receiver sheet steps are repeated at least once.

* * * * *

UNITED STATES PATENT AND TRADEMARK OFFICE

CERTIFICATE OF CORRECTION

PATENT NO. : 4,005,654

DATED : February 1, 1977

INVENTOR(S) : Robert W. Gundlach

It is certified that error appears in the above-identified patent and that said Letters Patent are hereby corrected as shown below:

Column 6, line 15 in Claim 1, "developer" should read --developed--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*